US011986748B2

(12) United States Patent
Welsh-Brockman

(10) Patent No.: US 11,986,748 B2
(45) Date of Patent: May 21, 2024

(54) POSEABLE AND SELF-STANDING DOLL COMPRISING INTERNAL WIRING AND METHODS OF MAKING AND USING THE SAME

(71) Applicant: Amy Lynn Welsh-Brockman, Apex, NC (US)

(72) Inventor: Amy Lynn Welsh-Brockman, Apex, NC (US)

( * ) Notice: Subject to any disclaimer, the term of this patent is extended or adjusted under 35 U.S.C. 154(b) by 148 days.

(21) Appl. No.: 17/481,982

(22) Filed: Sep. 22, 2021

(65) Prior Publication Data

US 2022/0249967 A1 Aug. 11, 2022

Related U.S. Application Data

(63) Continuation-in-part of application No. 17/172,425, filed on Feb. 10, 2021, now abandoned.

(51) Int. Cl.

| | |
|---|---|
| ***A63H 3/04*** | (2006.01) |
| ***A63H 3/02*** | (2006.01) |
| ***A63H 3/52*** | (2022.01) |
| ***A63H 9/00*** | (2006.01) |

(52) U.S. Cl.

CPC ..... *A63H 3/04* (2013.01); *A63H 3/02* (2013.01); *A63H 3/52* (2013.01); *A63H 9/00* (2013.01)

(58) Field of Classification Search

CPC ..... A63H 3/02; A63H 3/04; A63H 9/00

USPC ..... 446/373, 374

See application file for complete search history.

(56) References Cited

U.S. PATENT DOCUMENTS

| | | | | | |
|---|---|---|---|---|---|
| 424,587 | A * | 4/1890 | Whitney | A63H 3/04 | 446/374 |
| 1,255,446 | A * | 2/1918 | Lofgren | A63H 3/02 | 446/370 |
| 1,364,881 | A * | 1/1921 | Koch | A63H 3/04 | 446/374 |
| 1,409,411 | A * | 3/1922 | Rogers | A63H 3/04 | 446/374 |
| 1,782,576 | A * | 11/1930 | MacGregor | A63H 3/00 | 446/373 |
| 2,109,422 | A * | 2/1938 | Haughton | G03B 15/08 | 446/374 |
| 2,206,950 | A * | 7/1940 | Gregg | A63H 3/04 | 446/374 |
| 2,209,791 | A * | 7/1940 | Norriss | A47F 8/00 | 524/157 |

(Continued)

OTHER PUBLICATIONS http://khairunysarts.blogspot.com/2015/10/research-on-easy-human-figure-of-wire.html.
https://ar.pinterest.com/pin/12807180175073502/.
http://www.stitchedbycrystal.com/2014/12/tutorial-add-wire-to-elf-on-shelf.html.

*Primary Examiner* — Joseph B Baldori
(74) *Attorney, Agent, or Firm* — Ashley D. Johnson; Dogwood Patent and Trademark Law

(57) ABSTRACT

The invention is a poseable doll and methods of making a poseable doll. The doll includes an internal wire that extends across a torso region widthwise and into both arms. Two wires extend separately into each leg, through the torso, and into the head of the doll. Alternatively, a single wire can be bent with its bend in the head so that the bent single wire can extend through the central region and into both of the legs. Terminal ends of all the wires can be curled. The method may include retrofitting a non-poseable doll in some embodiments.

18 Claims, 18 Drawing Sheets

(56) References Cited

U.S. PATENT DOCUMENTS 2,340,172 A * 1/1944 Buchanan ..... A63H 9/00 446/370
2,535,818 A * 12/1950 Smalley ..... A63H 9/00 446/370
2,601,740 A * 7/1952 Schippert ..... A47F 8/00 446/374
2,636,318 A * 4/1953 Lock ..... A63H 3/02 446/369
3,395,484 A * 8/1968 Smith ..... A63H 3/04 446/374
3,432,581 A * 3/1969 Rosen ..... B29C 44/04 264/46.7
3,552,057 A * 1/1971 de Laillevault ..... A63H 3/04 446/374
3,678,616 A * 7/1972 Goldfarb ..... A63H 3/46 446/368
3,977,121 A * 8/1976 Goldfarb ..... A63H 3/00 446/369
4,143,453 A * 3/1979 Taluba ..... B29C 49/76 264/296
4,197,358 A * 4/1980 Garcia ..... A63H 3/04 446/374
4,233,775 A * 11/1980 Neufeld ..... A63H 3/04 446/370
4,245,429 A * 1/1981 Katzman ..... A63H 3/36 446/268
4,268,991 A * 5/1981 Cotey ..... A63H 3/46 446/373
4,728,313 A * 3/1988 Thomas ..... A63H 9/00 446/369
5,516,314 A * 5/1996 Anderson ..... A63H 3/36 446/268
5,630,745 A * 5/1997 Yeh ..... A63H 3/04 446/385
5,762,531 A * 6/1998 Witkin ..... A63H 3/04 446/374
6,155,904 A * 12/2000 Spector ..... A63B 69/34 446/311
6,193,577 B1 * 2/2001 Kaplan ..... A61N 2/002 446/72
6,403,003 B1 * 6/2002 Fekete ..... B29C 45/4421 264/318
6,464,557 B1 * 10/2002 Ohba ..... A63H 9/00 264/328.12
6,524,519 B1 * 2/2003 Ohba ..... A63H 9/00 264/55
6,612,896 B1 * 9/2003 Choi ..... A63H 3/04 446/369
6,746,303 B2 * 6/2004 Beidokhti ..... A63H 3/02 446/385
6,800,016 B2 * 10/2004 Wittenberg ..... A63H 3/04 446/376
6,805,607 B2 * 10/2004 Hidalgo ..... A63H 3/02 446/369
7,172,721 B2 * 2/2007 Wong ..... B29C 49/70 264/537
7,473,156 B2 * 1/2009 Hsieh ..... A63H 3/04 446/376
10,421,024 B2 * 9/2019 Stewart ..... B60L 15/20
2003/0092354 A1 * 5/2003 Wexler ..... A63H 3/02 446/369
2005/0191936 A1 * 9/2005 Marine ..... A63H 3/04 446/376
2008/0182479 A1 * 7/2008 Elliott ..... A63H 33/26 446/73
2009/0111354 A1 * 4/2009 Zheng ..... B68G 1/00 297/217.3
2012/0289117 A1 * 11/2012 Nielsen ..... A63H 3/16 446/100
2013/0109005 A1 * 5/2013 Hardy ..... A63H 3/04 403/53
2016/0228781 A1 * 8/2016 Duling ..... A63H 3/04
2022/0249966 A1 * 8/2022 Welsh-Brockman .... A63H 3/02

* cited by examiner

POSEABLE AND SELF-STANDING DOLL COMPRISING INTERNAL WIRING AND METHODS OF MAKING AND USING THE SAME

CROSS-REFERENCE TO RELATED APPLICATIONS

This application is a continuation-in-part of U.S. patent application Ser. No. 17/172,425 entitled "POSEABLE ELF DOLL HAVING A THERMOPLASTIC HEAD/NECK AND CLOTH-BODY RETROFITTED WITH STRANDS OF WIRE TO RENDER SAME POSEABLE AND SELF-STANDING" filed Feb. 10, 2021, the entire content of which is hereby incorporated by reference.

TECHNICAL FIELD

The presently disclosed subject matter is generally directed to a poseable and self-standing doll comprising internal wiring and methods of making and using the disclosed doll.

BACKGROUND

Dolls of various kinds, shapes, sizes, materials, and construction are well known and have been used and enjoyed by children and adults for many years. Conventional dolls are typically stuffed with a soft material, such as cotton, polyester, or fabric to ensure that the doll has a pliable and comfortable feel. As such, the dolls have no internal support and are unable to stand on their own or be posed. When not held by a user, conventional dolls must be supported by a vertical wall or other structure to be configured in a standing or sitting position. However, in these configurations, the doll is unstable and can easily topple over. Alternatively, the doll can also be connected to a stand, such as by ties, magnets, or other releasable elements. However, doll stands are unsightly and do not allow the doll to be posed or enjoyed fully by the user. It would therefore be advantageous to provide a doll that includes internal wiring to allow the doll to stand and/or be posed as desired by a user. It would also be beneficial to provide a method of wiring a conventional doll to allow it to be poseable and self-standing, such as with internal wiring.

SUMMARY

In some embodiments, the presently disclosed subject matter is directed to a self-standing, poseable doll. The doll comprises a head, a torso, and a pair of arms attached to the torso, each arm projecting outward from the torso to terminate at a distal end. The doll further includes a pair of legs attached to the torso, each leg projecting outward from the torso to terminate at a distal end. The doll comprises a pair of shoes, each shoe fitted on a distal end of a corresponding leg, each shoe comprising a flat lower surface. The doll includes an interior defined by strands of bendable wire that include curled ends that extend within the arms and legs. At least one of the strands of the bendable wire extends from one of the distal end regions of at least one of the legs and through the torso and into abutment with the head. The doll is rendered poseable by bending the strands of the bendable wire. The doll is in a self-standing position on a horizontal surface that remains self-standing because of the shoes fitted on that balance the doll and because of the at least one of the strands of the bendable wire that sturdies the doll.

In some embodiments, at least one of the strands of the bendable wire extends into both of the legs.

In some embodiments, the strands of bendable wire include a single strand extending into both of the arms, the single strand and one of the at least one further strands bypass each other in a manner that is free from wrapping around each other and free from connecting to each other.

In some embodiments, the at least one of the strands has a central portion that is bent or curves at a location neighboring the abutment.

In some embodiments, the at least one of the strands of the bendable wire includes two wires each within respective ones of the legs and each in a respective abutment with the head.

In some embodiments, the head is part of a hollow thermoplastic formation that also includes a neck, the torso and limbs are cloth-bodied and contain stuffing, the torso has an upper opening in alignment with the hollow of the neck and having a fabric loop around the neck; further comprising a cable tie within the fabric loop that is secured in a manner that fastens the torso to the neck.

In some embodiments, the distal end regions of the legs are feet.

In some embodiments, the head is hollow and has an inside facing surface, the abutment taking place because the at least one of the strands of the bendable wire abuts the inside facing surface of the head.

In some embodiments, the presently disclosed subject matter is directed to a method of forming a self-standing, poseable doll. The method comprises inserting strands of bendable wire within limbs of doll, a torso of the doll, and a head of the doll, the limbs projecting outward from the torso to each terminate at distal end regions, respectively, the limbs including a pair of arms and a pair of legs, the strands of bendable wire include curled ends. The method includes extending at least one of the strands of the bendable wire from one of the distal end regions of at least one of the legs through the torso and into abutment with the head. The method includes fitting shoes on the distal end regions of the legs, the shoes each having an underside that is flat. The doll is poseable by bending the strands of the bendable wire. The doll is self-standing upon a horizontal surface.

In some embodiments, the method further includes extending the at least one of the strands of the bendable wire into both of the legs.

In some embodiments, the strands of bendable wire include a single strand, further comprising extending the single strand into both of the arms; and bypassing the single strand and one of the at least one further strand with each other in a manner that is free from wrapping around each other and free from connecting to each other.

In some embodiments, the method includes bending or curving a central portion of the at least one of the strands at a location neighboring the abutment.

In some embodiments, at least one of the strands of the bendable wire includes two wires each within respective ones of the legs and each in a respective abutment with the head.

In some embodiments, the strands of bendable wire include a single strand extending into both of the arms, the single strand and the two wires bypassing each other in a manner that is free from wrapping around each other and free from connecting to each other.

In some embodiments, the head is part of a hollow thermoplastic formation that also includes a neck, the torso and the limbs are cloth-bodied and contain stuffing, the torso has an upper opening in alignment with the hollow of the neck and having a fabric loop around the neck.

In some embodiments, the doll of the method is a non-poseable doll that is converted into a poseable doll by providing access to an interior of the torso by detaching the head from the torso to expose an opening in the torso and by cutting stitching at seams in the arms and legs to expose openings where the stitching had been that had been cut; removing any stuffing from the torso and limbs via the access to the interior; effecting the step of inserting the strands of bendable wire; effecting the step of extending the at least one of the strands of the bendable wire from one of the distal end regions of at least one of the legs through the torso and into abutment with the head upon reattaching the head to the torso; restoring the removed stuffing in the doll and stitching closed the exposed openings; and effecting the steps of fitting, posing and self-standing.

DETAILED DESCRIPTION

Figure 1:
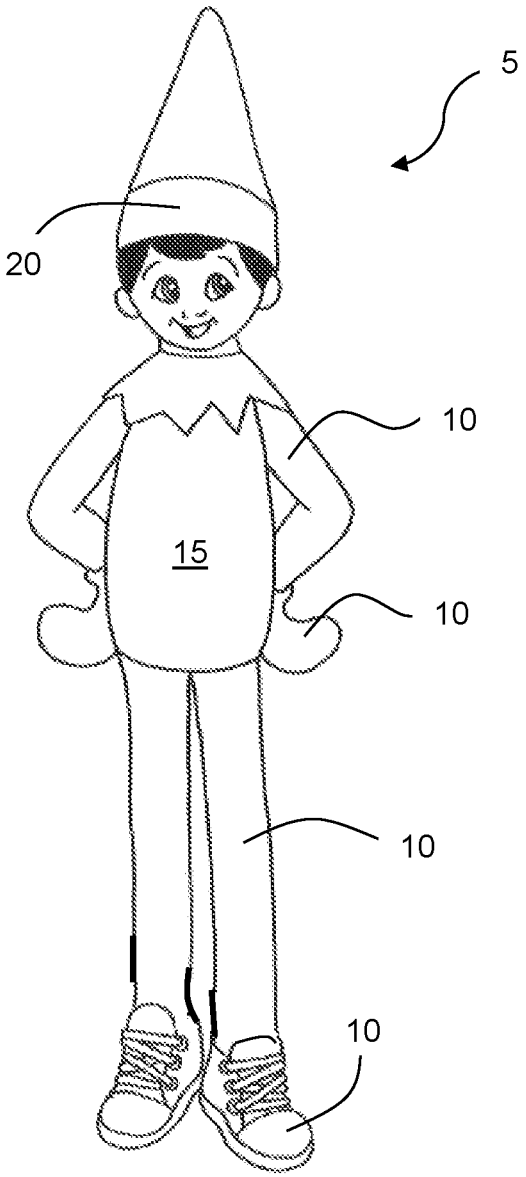
FIG. 1 is a front plan view of a poseable and self-standing doll in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a poseable doll comprising a system of internal wiring, and to methods of making and using the disclosed doll. The term "doll" broadly refers to any of a wide variety of models of human figures, animals, and the like commonly used as child's toys and/or adult collectible items. For example, the term "doll" can include large or small models of human babies, dogs, cats, and the like. FIG. 1 illustrates one example of doll 5 configured as an elf doll, although the term is not limited to any particular type of doll. For example, the doll can be constructed using any conventional method and/or can include any conventional materials (e.g., porcelain head, plastic head/body/appendages, fabric head, plush animal, and the like). The doll can further have any suitable size, such as about 1-12 inches in height or more.

In some embodiments, the presently disclosed subject matter includes a method of adding wiring to a doll to make a non-poseable doll poseable and/or self-standing. The term "poseable" refers to the characteristic of being able to be posed or moved into various postures. Thus, a poseable doll can include appendages 10 (e.g., hands, arms, feet, legs), torso 15, and/or head 20 that can be moved, angled, turned, and/or shaped. For example, the doll's head can be turned to the left, right, upwards, downwards, straight ahead, or even in a rearward direction. The doll's appendages can be conformed in any desired shape (a waving hand, extended arm, angled leg, etc.). Further, the doll's torso can be twisted or bent at any angle.

The term "self-standing" refers to the characteristic of the disclosed doll to remain standing in an upright positioned (e.g., balanced on at least two legs) without requiring the doll to lean or contact another element, such as a stand or a user's hand. Thus, a self-standing doll can remain upright without support.

Figure 2A:
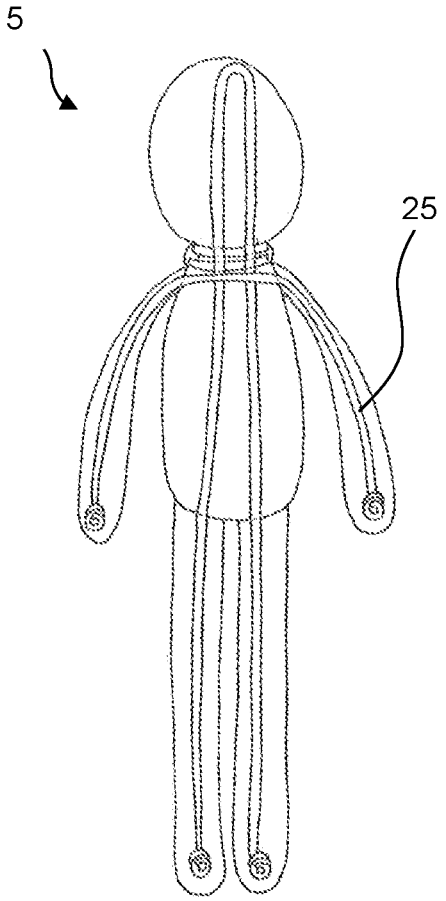
FIG. 2*a* is a front plan view of the interior wiring of a poseable and self-standing doll in accordance with some embodiments of the presently disclosed subject matter.
Figure 2B:
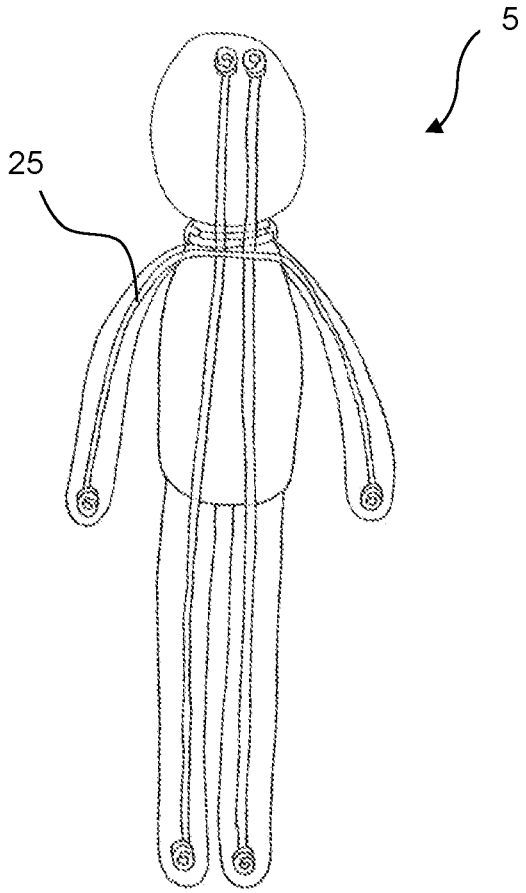
FIG. 2*b* is a front plan view of the interior wiring of a poseable and self-standing doll in accordance with some embodiments of the presently disclosed subject matter.

FIGS. 2*a* and 2*b* illustrate two embodiments of the interior of doll 5, which includes wiring 25 that allows the doll to be posed. Thus, doll 5 can include an interior defined by wiring 25 positioned in at least one of the doll's head 20, torso 15, or appendage(s) 10. Particularly, each segment of wiring includes rolled regions at each end that help to stabilize the doll in the self-standing configurations, as explained in more detail below.

The term "wiring" refers to at least one strand, rod, or cord of a pliable material that provides structural support. A suitable wire can have an elliptical, round, or cylindrical cross-sectional shape, or can have a more ribbon-like, flattened cross-sectional shape (although any shape can be used). The wire can have a diameter of about 0.001-1 inches (e.g., at least/no more than about 0.001, 0.005, 0.01, 0.05, 0.1, 0.2, 0.3, 0.4, 0.5, 0.6, 0.7, 0.8, 0.9, or 1 inch). However, the diameter of wire 25 is not limited and can be configured outside the range given above.

Wiring 25 can be constructed from any suitable material, such as (but not limited to) metal (e.g., aluminum, copper, etc.), metal alloy, plastic, and the like. In some embodiments, the wiring can have memory, such that it is shaped by a user, it retains that shape until the user changes the wiring to a different shape.

As shown, the wiring can extend to the head, torso, and/or appendages of the doll as described in detail below.

Figure 3:
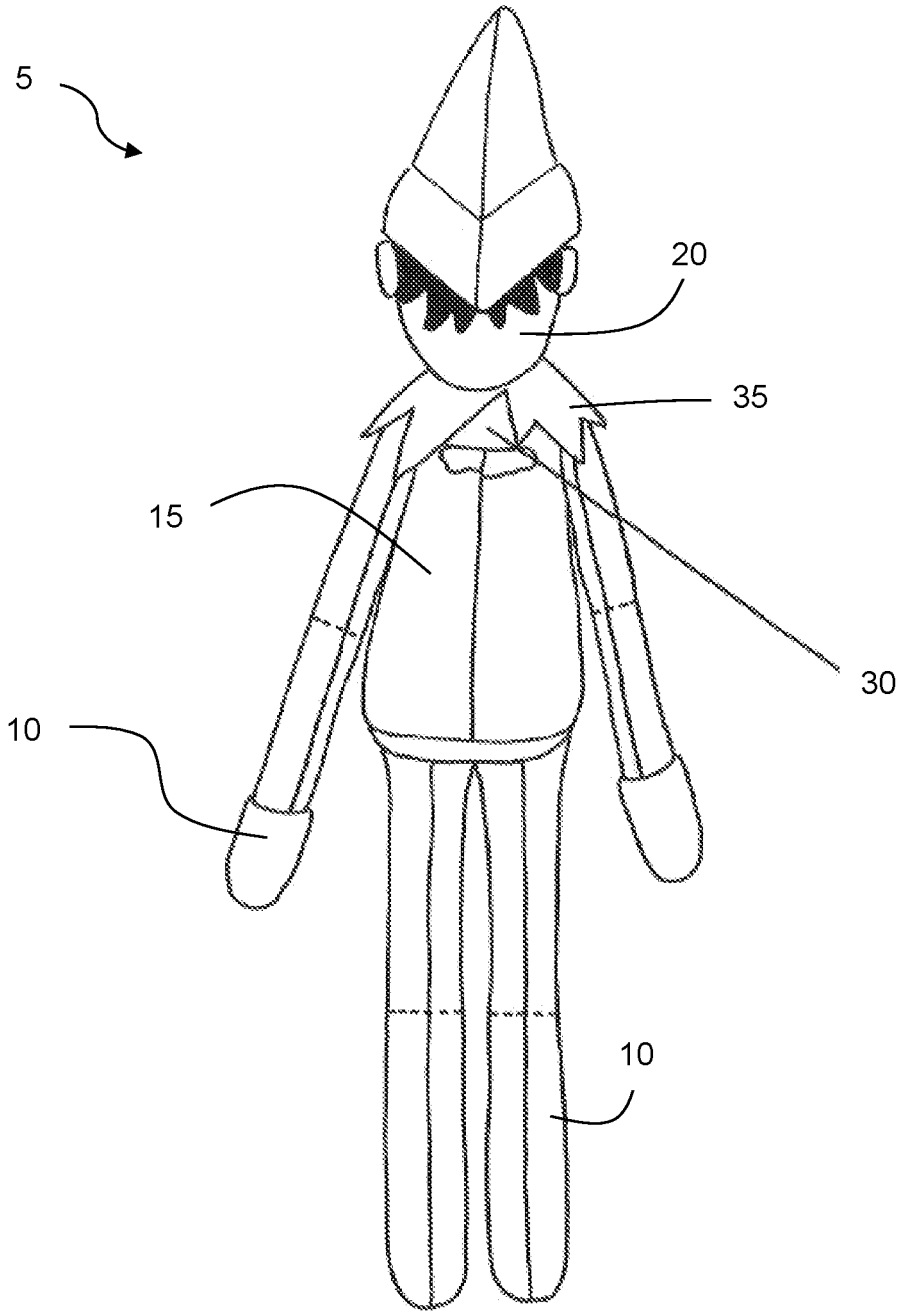
FIG. 3 is a rear plan view of a doll in accordance with some embodiments of the presently disclosed subject matter.

The presently disclosed subject matter includes methods that can be used to construct doll 5. Specifically, a doll is typically constructed with a front and back. The front side of the doll is the side that includes the face, while the back side of the doll opposes the front side. When retrofitting a conventional doll with the disclosed wiring, the clothing of doll is typically removed as a first step. For example, the back of doll 5 can include a portion of adhesive 30 that secures clothing 35 (e.g., shirt, dress, bib, and the like) to the doll, as shown in FIG. 3. The adhesive can further conceal cable tie head 40 that attaches doll head 20 to the remainder of the doll body. Alternatively, the doll's clothing can be removed using any suitable method (e.g., unbuttoning, zipping, elastic openings, cutting, and the like). Further, the doll's head can be removed using any known method, such as a snap-fit, pressure-fit, etc.

Figure 4:
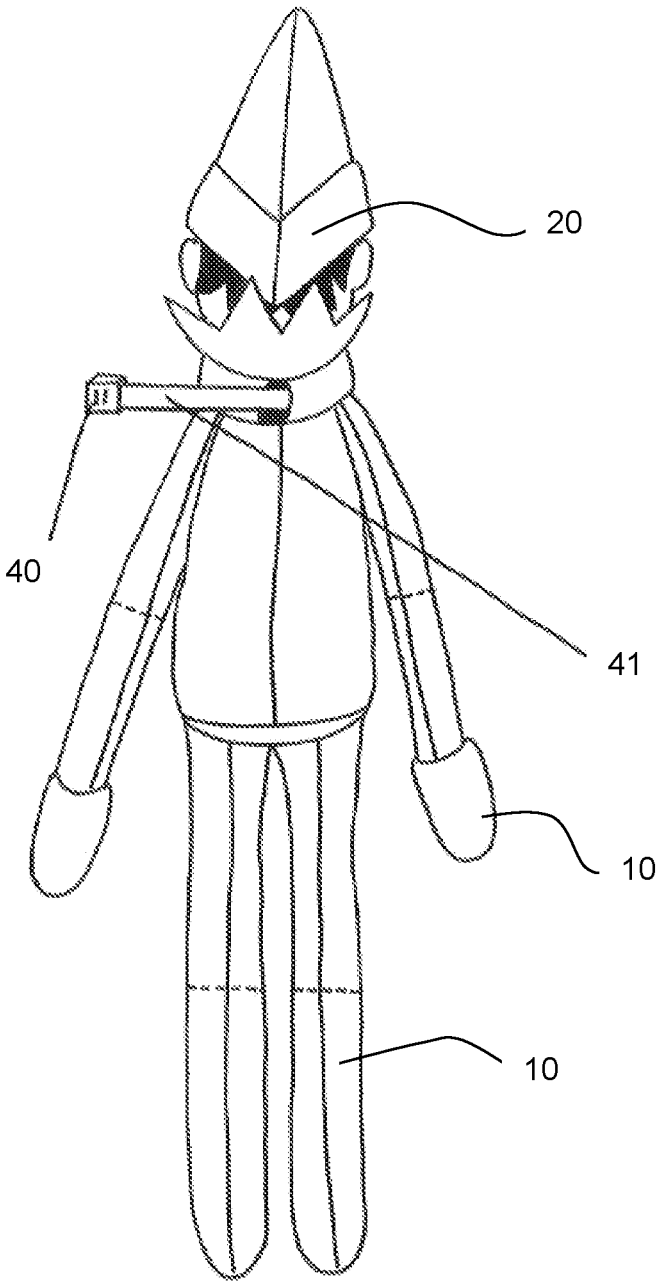
FIG. 4 is a rear plan view of a doll with a cable tie in accordance with some embodiments of the presently disclosed subject matter.

In some embodiments, the clothing can be constructed from fragile material that is susceptible to ripping and/or tearing (e.g., felt, lace, and the like). Due to the fragility of clothing 35, it may be impossible to remove or reposition the clothing to remove head 20 (e.g., access cable tie head 40) without ripping clothing. Therefore, adhesive 30 can be removed to access the cable tie head. For example, the metal tip of a heated hot glue gun can be positioned adjacent to the adhesive to loosen/melt the adhesive. However, any method can be used. After adhesive 30 is removed, cable tie head 40 can be accessed, as shown in FIG. 4. The cable tie head is positioned at a first end of a corresponding cable tie 41 and functions to secure the cable tie at a desired circumference. It should be appreciated that any securing element can be used in place of cable tie 41 to maintain the doll head on the body.

Figure 5:
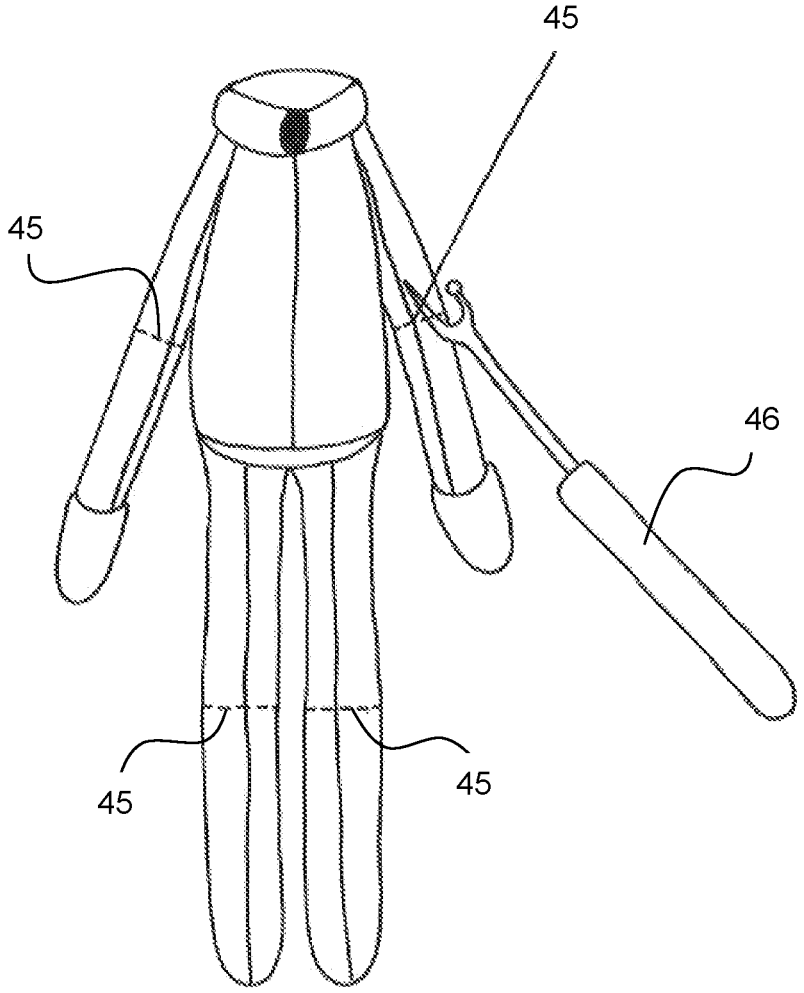
FIGS. 5-7 are front plan views of a doll depicting removal of seams in accordance with some embodiments of the presently disclosed subject matter.

The cable tie head can be cut with a sharp device, such as scissors, wire cutters, pliers, a knife, a blade, etc. After the cable tie head is disconnected, the cable tie can be removed from doll 5. It should be appreciated that the presently disclosed subject matter is not limited to dolls that include a head attached via a cable tie. Rather, any method of removing a doll head can be used. Head 20 can then be detached from the remainder of the doll body, as shown in FIG. 5. Thus, the disclosed method generally includes removing a doll head and/or clothing from the remainder of the doll body.

The interior of doll 5 includes stuffing material, which can include (but is not limited to) fabric, cotton, beans, and the like. For example, some dolls can include a small weight (e.g., bag of beans or other materials) positioned in the torso that facilitate maneuvering the doll in a sitting position. When adding wiring to an existing doll, the stuffing from torso 15 can be removed using any method, such as pulling from the hole remaining after head 20 has been removed. All or a portion of the stuffing can be removed (e.g., about 100 percent or 95-50 percent or 10-50 percent). Thus at least about (or no more than about) 10, 15, 20, 25, 30, 35, 40, 45, 50, 55, 60, 65, 70, 75, 80, 85, 90, 95, or 100% of the stuffing can be removed from the doll interior (e.g., the inside of the torso and appendages).

Doll 5 can include seams 45 that extend along at least a portion of the torso and/or one or more appendages. The term "seam" refers to any joining of two materials, such as through the use of threads, adhesive, VELCRO®, magnets, and the like. Doll 5 can include seams at a variety of locations, such as at the "joints" (e.g., elbows, knees, legs, feet, arms, hands, neck, waist, armpit). The method includes at least partially breaking seams 45 to expose the interior of the appendages and/or torso. For example, utensil 46 (e.g., seam ripper, blade, scissors) can be used to cut seam threads, as shown in FIG. 5. In some embodiments, the seams attaching the doll hands 47 (or mittens) to the doll can also be removed. For example, a hand can be added to the doll (e.g., a hand gripping a purse, baton, or any other item). Advantageously, removal of seams 45 allows the addition of wiring 25 into the interior of the doll and permits posing of the doll. However, seams 45 are optional and doll 5 can be configured without seams.

Figure 6:
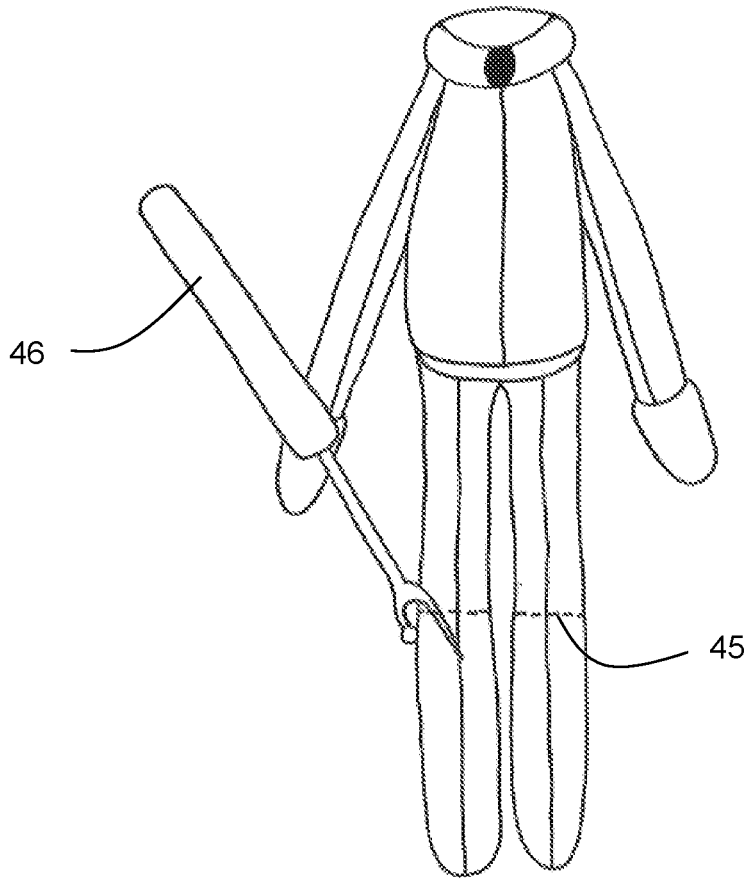
Figure 7:
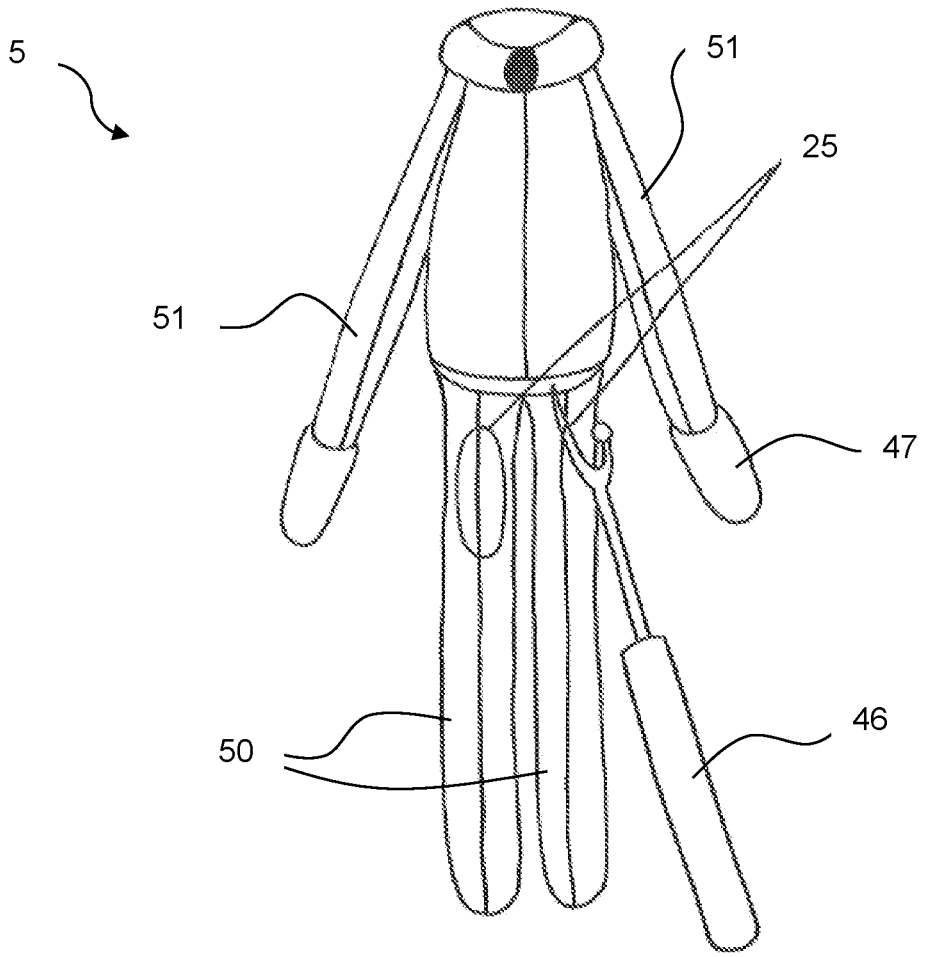
Figure 8:
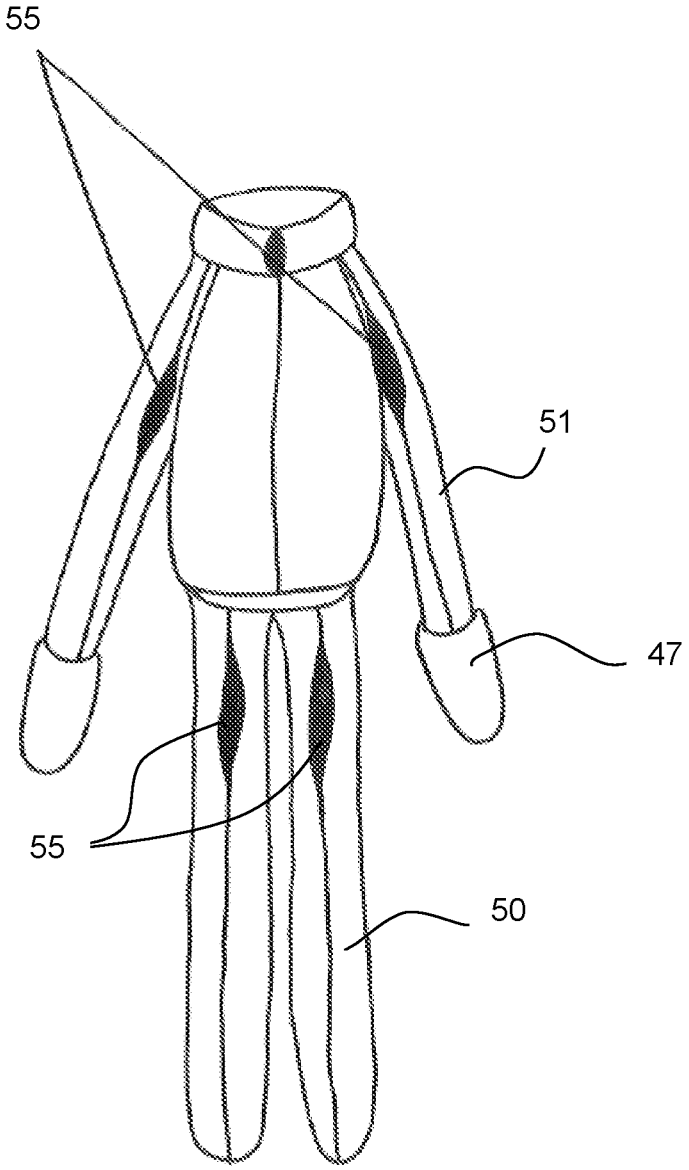
FIG. 8 is a front plan view of a doll with a plurality of seam openings in accordance with some embodiments of the presently disclosed subject matter.

As illustrated in FIGS. 6-8, all or a portion of a seam can be removed. For example, at least a portion of seam 45 on both sides of a doll appendage (e.g., legs 50 and/or arms 51) can be removed, creating opening 55. For example, the seams on the arms adjacent to a corresponding armpit area can be removed. Openings 55 can have any desired length, such as (but not limited to) about 0.1-2 inches or more (e.g., at least/no more than about 0.1, 0.5, 1, 1.5, 2, or more inches).

Openings 55 allow any desired amount of stuffing present within the doll arms and legs to be removed. After the appendage stuffing has been withdrawn from the interior, doll 5 can be completely void of any filler or stuffing material and can be a hollow shell. Alternatively, a desired amount of stuffing (e.g., about 25 percent or less of the original amount) can remain.

Figure 9:
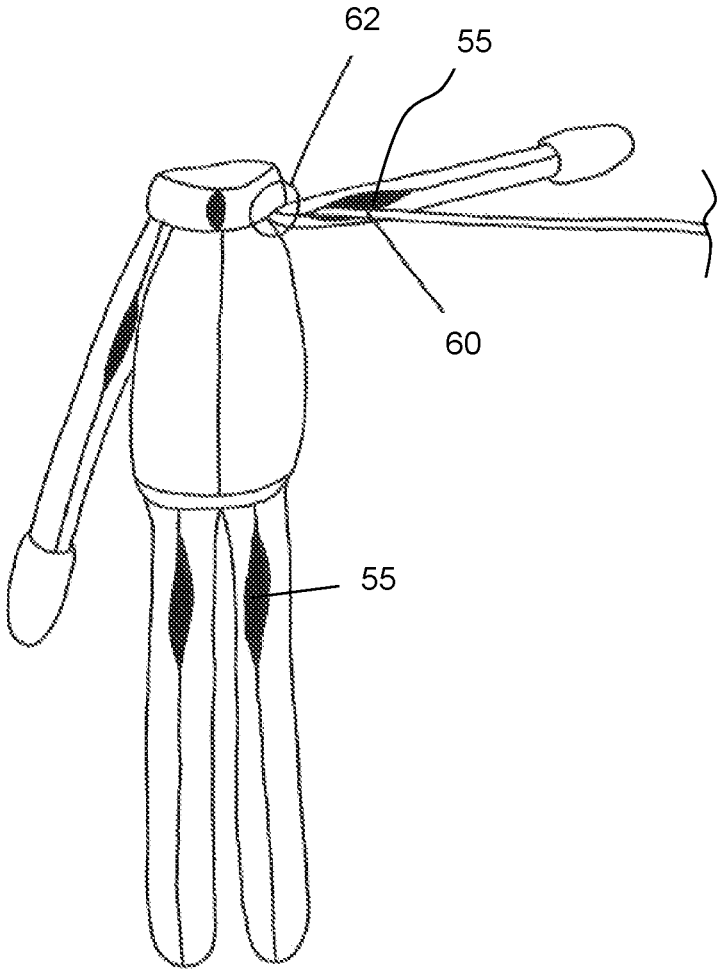
FIGS. 9 and 10 are front plan views of a doll with wiring inserted into the arms in accordance with some embodiments of the presently disclosed subject matter.
Figure 10:
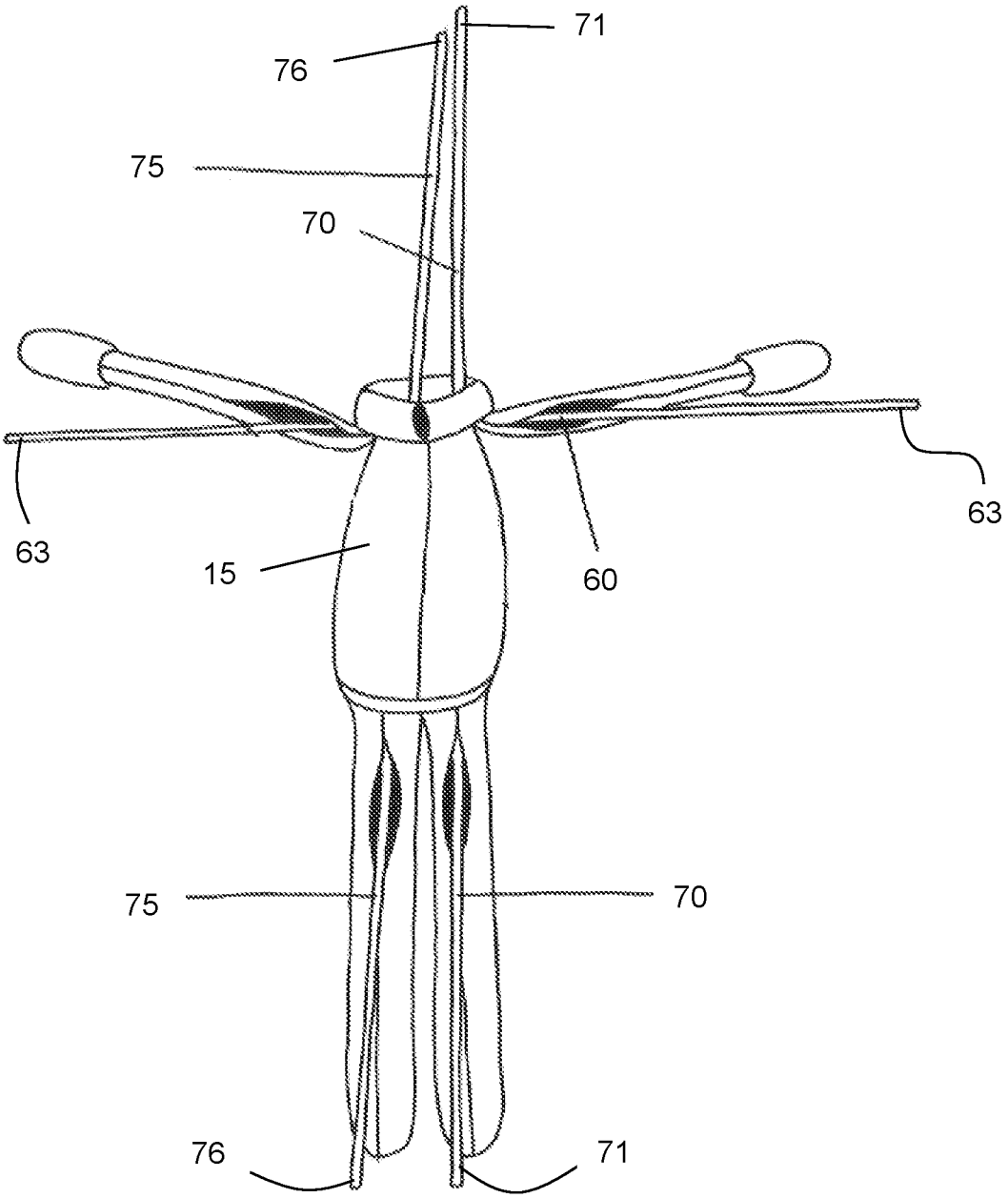

First wire 60 can be inserted into arm opening 55 in a first arm of doll 5 to pass from the arm into torso 15 and extend through the second arm opening 55, as shown in FIGS. 9 and 10. Wire 60 can pass through any interior seams 62, such as those that attach the arms to torso 15. Thus, each end 63 of wire 60 is on the exterior of the doll, while the length of the wire extends through from first arm opening to second arm opening through the torso of the doll.

Second wire 70 can then be inserted through a first leg opening 55 and guided in an upward direction to reach torso 15. The wire can be configured to pass through any interior seams (e.g., seams that attach the leg to the torso) with a small gauge (e.g., 10-20 gauge). The second wire further extends through neck opening 65 (the opening created by the removal of head 10). Accordingly, each end 71 of wire 70 is configured on the exterior of the doll, while the length of the wire extends from a first leg opening through the leg and torso to exit from neck opening 65.

Third wire 75 can then be inserted through the second leg opening and is guided through the doll as discussed with second wire. Thus, each end 76 of wire 75 is configured on the exterior of the doll, while the length of the wire extends from a first leg opening through the leg and torso to exit from neck opening 65.

Alternatively, a single wire can pass through both legs. Specifically, a single wire can enter a first opening 55 positioned on a first leg and extend in an upward direction through torso 15 and out neck opening 65. The wire can then be bent and re-inserted within the torso and passed through the second leg opening to exit the doll, as shown in FIG. 2*a*. The bent region positioned at the top of the doll is sized to be hidden within the interior of the doll head once the doll is reassembled as described below.

Any stuffing materials can then be inserted into torso 15 and positioned around wires 60, 70, and 75 within the torso interior.

Figure 12A:
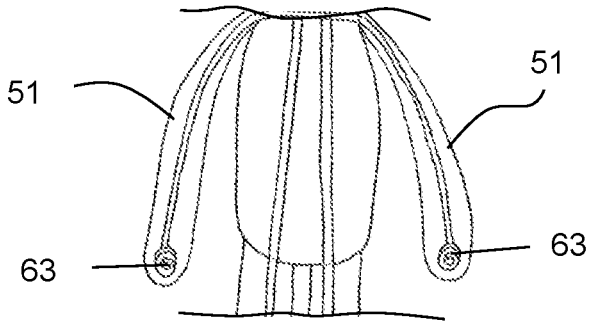
FIG. 12*a* is a front plan view of a doll with curled wire ends configured in the arm or hand regions in accordance with some embodiments of the presently disclosed subject matter.
Figure 12B:
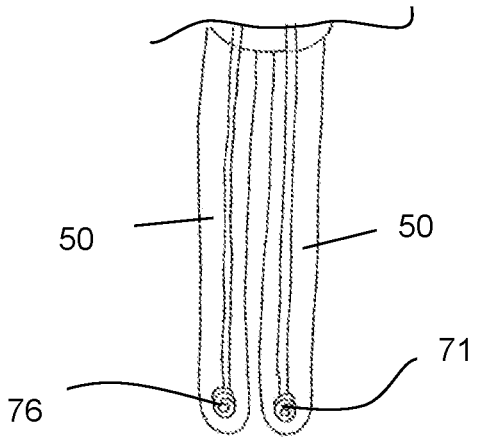
FIG. 12*b* is a front plan view of a doll with curled wire ends configured in the leg or feet regions in accordance with some embodiments of the presently disclosed subject matter.
Figure 12C:
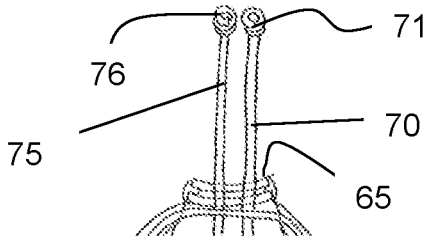
FIGS. 12*c* and 12*d* are front plan views of a doll with curled wire ends configured in the head region in accordance with some embodiments of the presently disclosed subject matter.
Figure 12D:
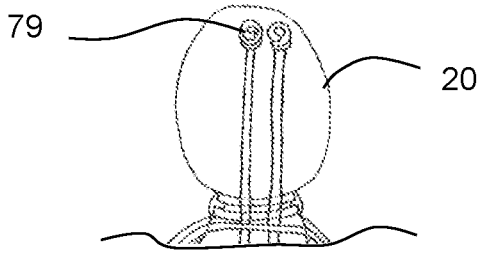
Figure 12E:
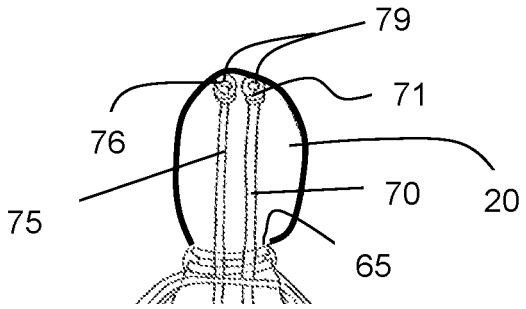
FIG. 12*e* is a front plan view of a doll with curled wire ends with a head attached in accordance with some embodiments of the presently disclosed subject matter.

Wire ends 63, 71, 76, that are exterior to the doll can be curled in a circular shape to prevent damage and to provide stability. However, it should be appreciated that any shape can be used. For example, each end 63 of wire 60 can be curled and positioned within the interior of the doll, at approximately the location of the doll hand, as shown in FIG. 12*a*. Excess wire length can be clipped off or otherwise removed. Similarly, ends 71 and 76 of each of wires 70, 75 can be curled and positioned at the foot portions of the doll, as shown in FIG. 12*b*. The second end of each of wires 70, 75 can be curled with a length sufficient to accommodate the doll head when reattached, as shown in FIGS. 12*c* and 12*d*. Importantly, the curled ends positioned within the interior of the head provide stability when balancing the doll to stand. Further, curled regions 79 can contact the interior of head 20 as shown in FIG. 12*e*. Importantly, contact between curled region 79 and the interior of head 20 functions to stabilize the doll when standing. Particularly, the contact steadies the wiring and prevents wobbling of the wiring within the interior of the doll, thereby reducing unsteadiness. Because contact with the head reduces interior movement of the wiring within the doll interior, stability is increased, and the doll can more easily self-stand.

It should also be appreciated that doll 5 can include embodiments where the curled ends 79 of the wire do not directly contact the interior of the head. Rather, the curled ends are configured adjacent to (but not touching) the doll head interior. Thus, the presently disclosed subject matter includes embodiments where the curled ends are directly adjacent to or contacting the head interior (e.g., physically touching). The subject matter also includes embodiments where the curled ends are adjacent to or within the interior of the head, but not physically touching.

Any method can be used to curl the wire ends, such as (but not limited to) the use of pliers or other tools. The curled ends prevent damage to the interior portions of the doll (e.g., the interior of head 20, feet, hands). Any tool can be used to properly feed the curled end to the correct position within the interior of the doll. The doll arms and legs are then properly wired.

Figure 11:
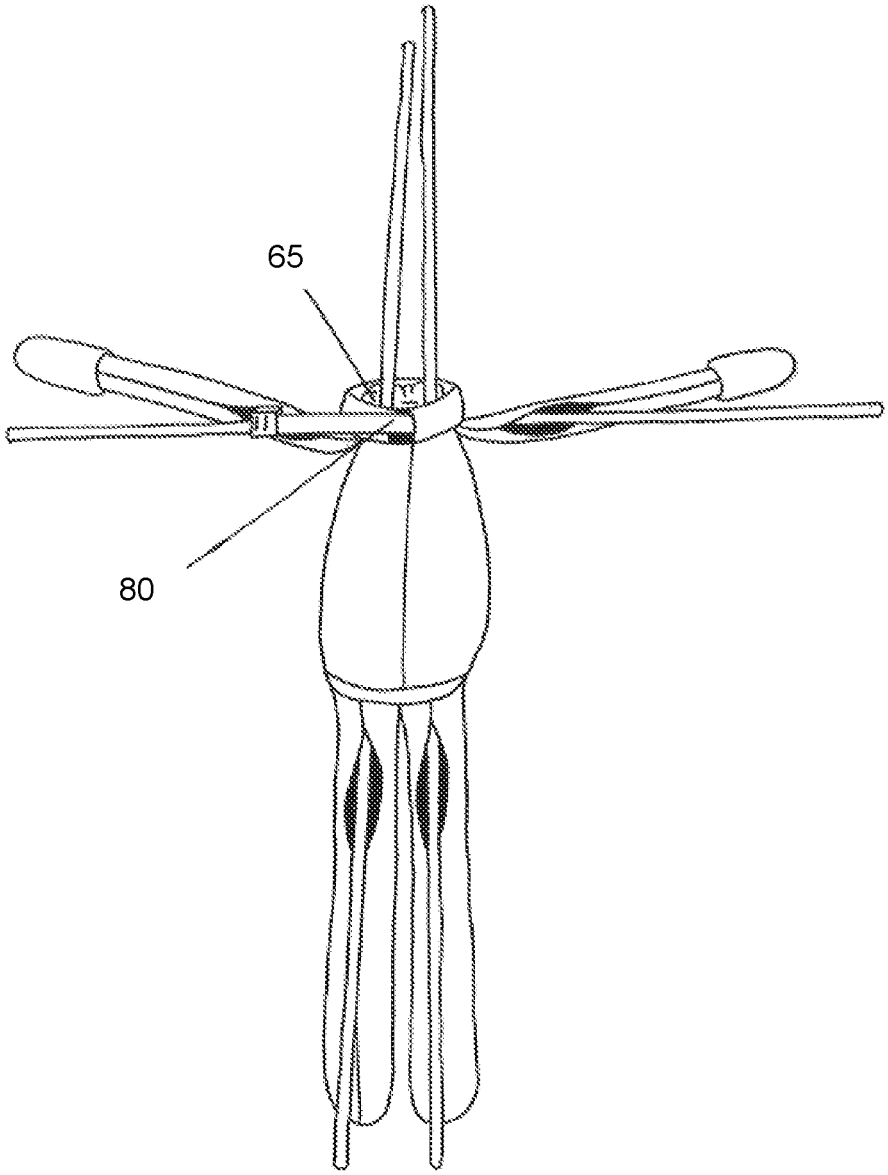
FIG. 11 is a front plan view of a doll with arm and leg wiring in accordance with some embodiments of the presently disclosed subject matter.

Either before or after the wire ends are curled, head 20 can then be repositioned on the torso at neck opening 65 using any conventional method. For example, cable tie 80 (e.g., one 4-inch, 18-pound tensile strength cable tie) can be used to secure the head back on the doll, as shown in FIG. 11. The cable tie can be fed through a loop of fabric on the doll neck, although any method can be used. Any excess length of the cable tie can be removed. Head 20 is therefore secure on torso 15 with only a cable tie head visible (just as it was prior to initially breaking the tie head to remove the head). However, it should be appreciated that any method of securing head 20 back on the torso can be used and the presently disclosed subject matter is not limited to dolls that include a head held using a cable tie.

Figure 13:
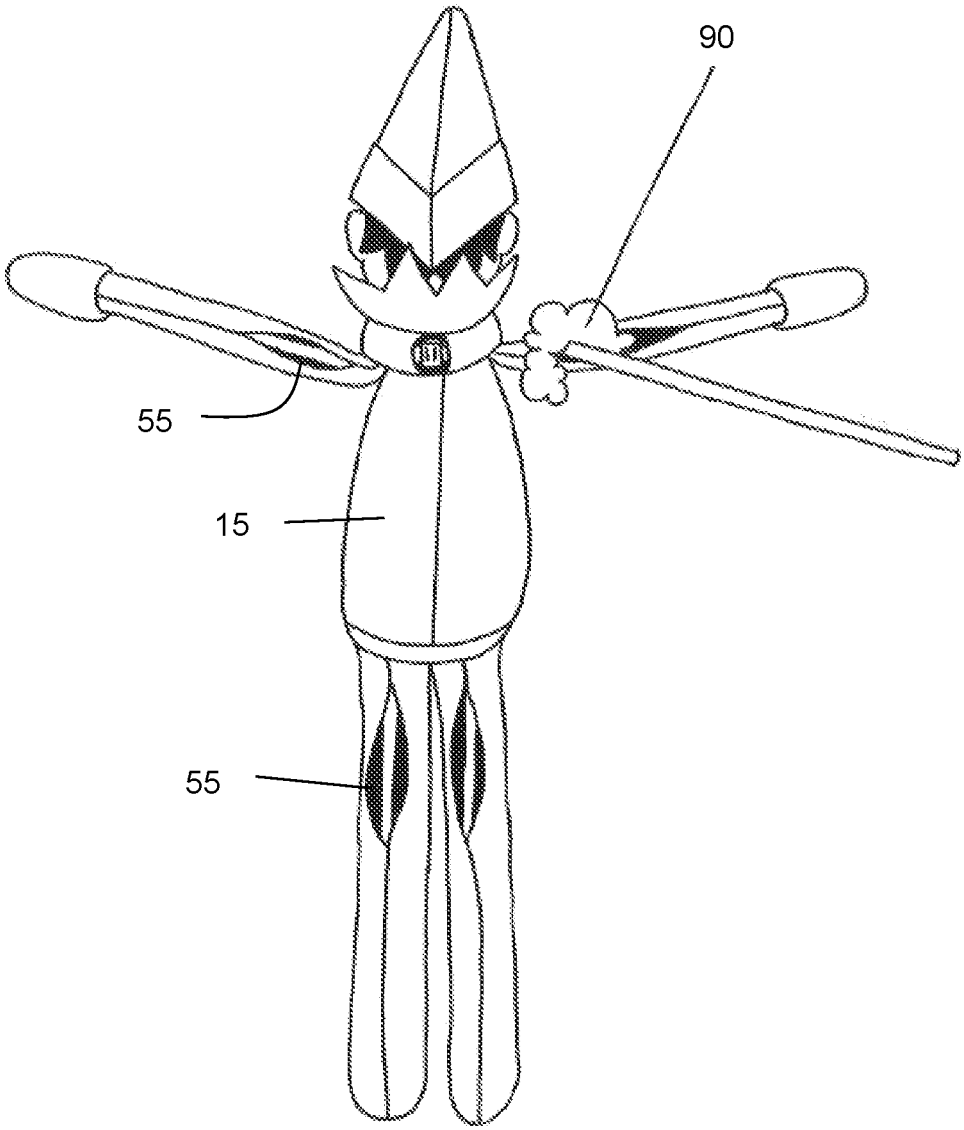
FIGS. 13 and 14 are rear plan views of a doll with added stuffing in accordance with some embodiments of the presently disclosed subject matter.
Figure 14:
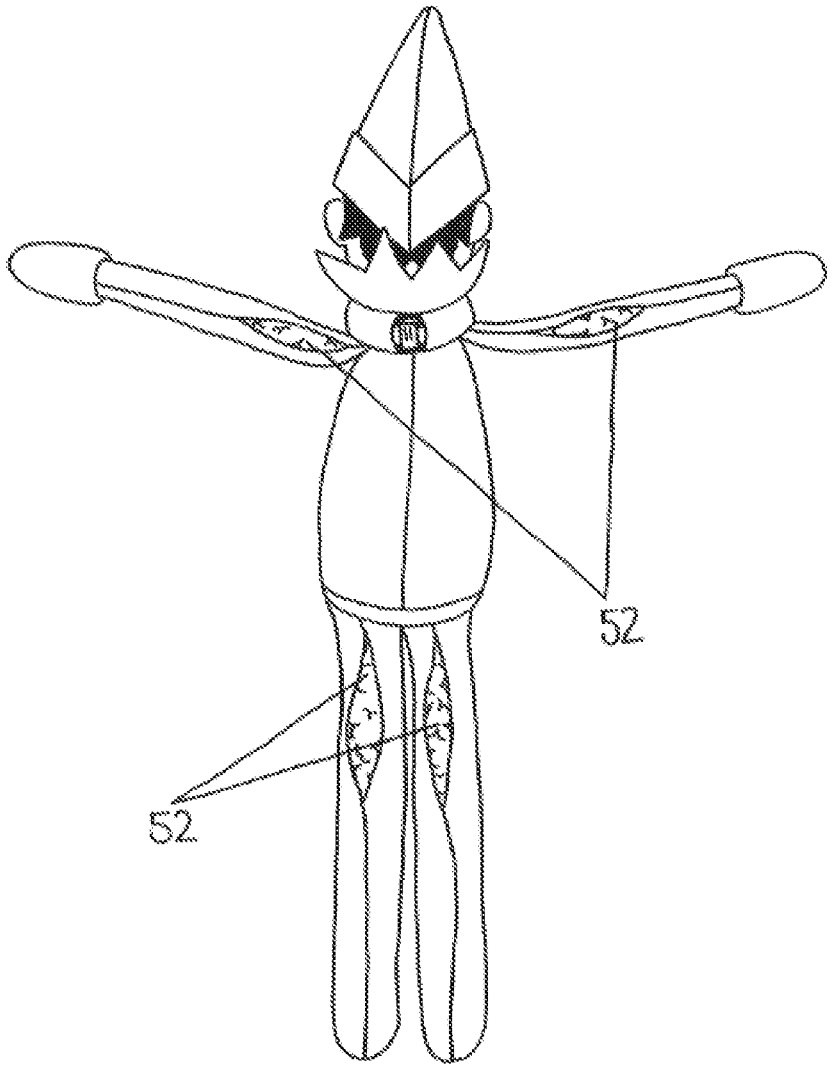

Any desired stuffing 90 can then be added back to the arms and legs of doll 5 through openings 55, as shown in FIGS. 13 and 14. Any suitable tool can be used to add the stuffing, such as (but not limited to) a dowel to allow the stuffing to reach the appendage extremities, such as the hands and feet.

Figure 15:
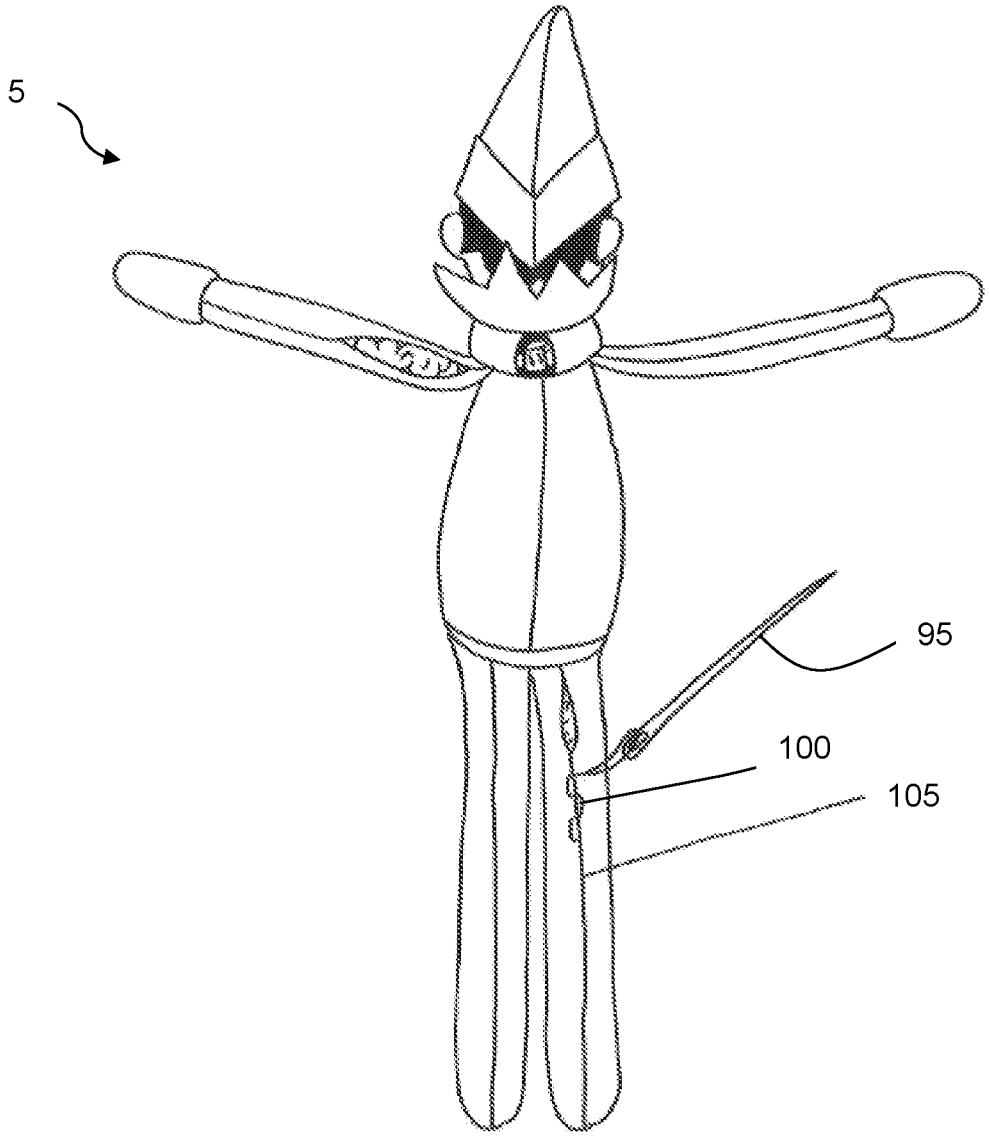
FIG. 15 is a rear plan view of a doll with seams restitched in accordance with some embodiments of the presently disclosed subject matter.

After the desired amount of stuffing has been added, openings 55 can be closed using any suitable method, such as with needle 95 and thread 100, VELCRO®, the use of magnets, fasteners (snaps, clips), and the like, as illustrated in FIG. 15. Thus, in some embodiments, the openings can be stitched shut using an invisible stitch. The term "invisible stich" refers to a method of joining two pieces of material such that the stitch thread is invisible or nearly invisible (e.g., the stitching is hidden under folded edges to create a blind hem or join two folded edges together). Seam 105 is therefore created along the arms and legs of the doll.

Figure 16:
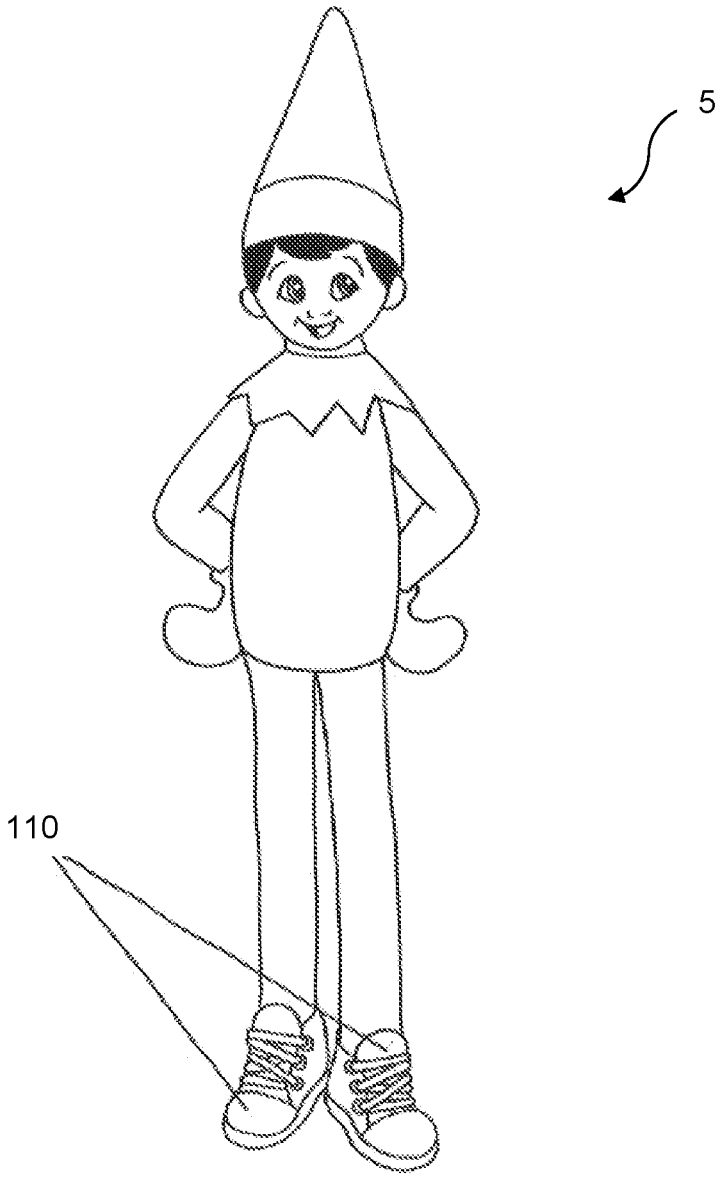
FIG. 16 is a front plan view of a doll with internal wiring in a posed position in accordance with some embodiments of the presently disclosed subject matter.

In some embodiments, a portion of adhesive 85 can be added to the back of the doll on the cable tie head to conceal the tie head and to prevent injury from inadvertent contact. Doll 5 has therefore been wired and can be posed as desired by the user, as shown in FIG. 16. For example, the doll arms 51, legs 50, hands 47, feet, head 20, and torso can be moved, angled, or otherwise posed in any desired configuration.

As shown, shoes 110 are configured on each distal end regions of the legs (such as feet) to balance the doll in self-standing. Shoes 110 can include a flat under side portion that is level with a supporting surface (such as a table or the ground). The term "flat surface" also includes embodiments when the shoes have cleats or other attachments, so long as the shoes can lie flat on a level surface. The shoes can be made of a fabric or leather material and have a sturdier material such as cardboard inside upon which is placed the foot of the doll or the distal end region of the leg. Further, the shoes can be permanently attached to the distal end of legs 50 or can be removable in some embodiments. The shoes act as a stand for doll 5, providing stability and a support for the doll.

Figure 17A:
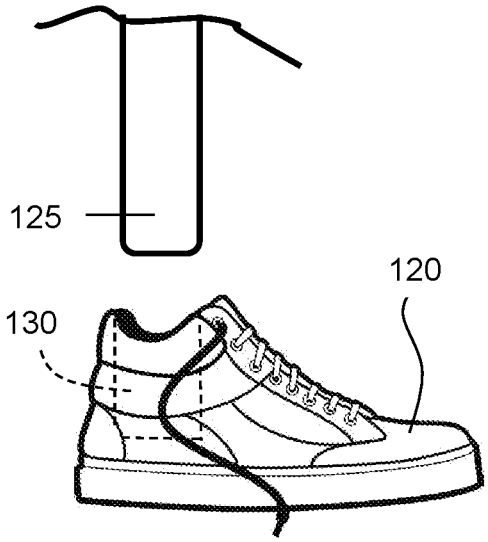
FIGS. 17*a* and 17*b* illustrate one embodiment of inserting a shoe onto a doll foot in accordance with some embodiments of the presently disclosed subject matter.
Figure 17B:
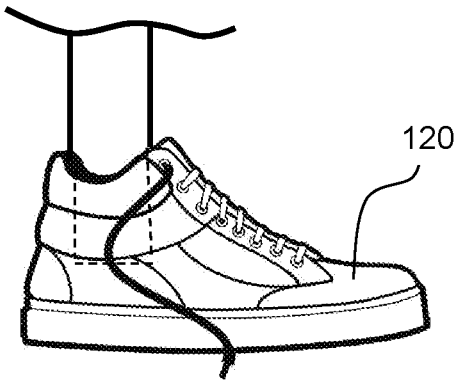
Figure 17C:
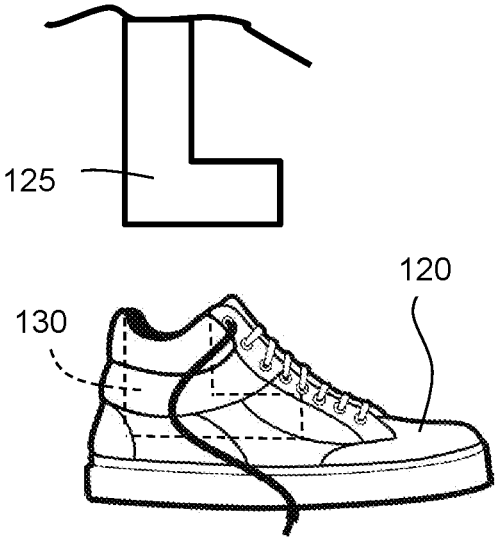
FIGS. 17*c* and 17*d* illustrate one embodiment of inserting a shoe onto a doll foot in accordance with some embodiments of the presently disclosed subject matter.
Figure 17D:
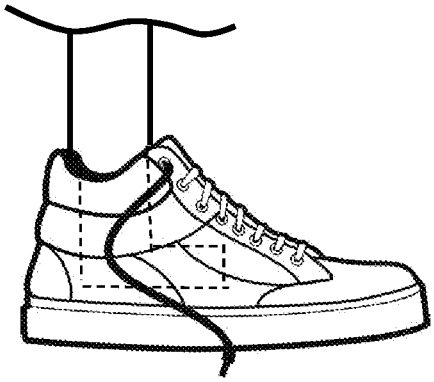

To put shoes 120 on the doll's feet (e.g., the lower part of each leg), doll foot 125 can be directly inserted into the shoe interior, as shown in FIGS. 17*a*-17*b*. Shoe interior cavity 130 can mimic the shape of the doll foot. The foot is maintained in the shoe through any suitable mechanism (e.g., pressure fit, snap fit, magnets, clips, fasteners, etc.). Alternatively, the foot can be shaped (via the doll internal wiring) to a desired shape that is accommodated within the shoe interior. For example, the foot can be formed into an L-shape that is accommodated within the shoe, as shown in FIGS. 17*c*-17*d*. Shoes 120 can be configured with a thick sole to assist in the role of acting as a base (e.g., the shoe sole can be about 0.1-1 inches in thickness).

Therefore, doll 5 can include an exterior and an interior. The interior can include one or more wires that extend the length of the doll's torso and appendages. The wiring can be extended into the interior of the doll's head. The ends of each wire can be rolled, ending in the distal region of each appendage (e.g., the hands and feet) and in the head, where the rolled portion contacts the interior of the doll's head. The doll can also include shoes 120 configured adjacent to and around the doll's feet, acting as a base to facilitate standing of the doll.

Advantageously, doll 5 is configured to self-stand without toppling on a horizontal surface because of the bendable wire placement, i.e., the wires in the legs extend in effect from the shoes to abut the head and thus sturdies the doll by adding rigidity. The term "self-stand" refers to the characteristic of being able to stand without an external support (e.g., user hand, being propped against a surface, etc.). The shoes themselves provide balance to the doll in a self-standing position to enable its retention in the self-standing position without toppling.

The foregoing descriptions have been presented for purposes of illustration and description and are not intended to be exhaustive or to limit the presently disclosed subject matter. Many modifications and variations are possible in light of the present disclosure.

What is claimed is:

1. A self-standing, poseable doll, comprising:

a head;

a torso;

a neck positioned between the head and torso, wherein the neck comprises a hollow that is aligned with an upper opening in the torso and wherein the neck includes a fabric loop positioned around an exterior of the neck, and wherein a cable tie is positioned within the fabric loop to fasten the torso to the neck;

first and second arms attached to the torso, each arm projecting outward from the torso to terminate at a distal end;

a pair of legs defined as a first leg and a second leg attached to the torso, each leg projecting outward from the torso to terminate at a distal end;

a pair of shoes, each shoe fitted on a distal end of a corresponding leg, each shoe comprising a flat lower surface and an interior that cooperates with the distal end of a corresponding leg, wherein each shoe acts as a stand to provide balance to the doll in a self-standing position to enable retention in the self-standing position;

first and second strands of bendable wire defined by curled ends that extend within the head torso, and legs, wherein the first leg includes the first strand of bendable wire that extends from the distal end of the first leg, through the torso, and into an interior of the head as a single strand, terminating at a curled end, and wherein the second leg includes the second strand of bendable wire that extends from the distal end of the second leg, though the torso and into an interior of the head as a single strand, terminating at a curled end;

a single strand of bendable arm wire extending from a distal end of the first arm, through the torso and into the second arm, extending to a distal end of the second arm, wherein the single strand of arm wire and the first and second strands of bendable wire bypass each other in the torso in a manner that is free from wrapping around each other and free from connecting to each other;

wherein the first strand runs alongside with the second strand as the strands extend from the first and second legs, through the torso, and into the head;

wherein the first and second strands of bendable wire include two ends, each configured in a rolled orientation;

wherein the doll is rendered poseable by bending the first and second strands of the bendable wire and the single strand of bendable arm wire;

wherein the doll is in a self-standing position on a horizontal surface that remains self-standing because of the shoes fitted on that balance the doll and because of the at least one of the first and second strands of the bendable wire that sturdies the doll.

2. The doll of claim 1, wherein the first and second strands of bendable wire positioned within the interior of the head directly contact the head.

3. The doll of claim 1, wherein the head is part of a hollow thermoplastic formation that also includes the neck, the torso and limbs are cloth-bodied and include stuffing.

4. The doll of claim 1, wherein the distal end regions of the legs are feet.

5. The doll of claim 1, wherein the head is hollow and has an inside facing surface, wherein at least one of the strands of the first and second strands of bendable wire abuts the inside facing surface of the head.

6. The doll of claim 1, wherein the rolled region is defined as a coiled wire region in a circular shape.

7. The doll of claim 1, wherein the wiring has memory such that it retains a shape until changed by a user.

8. The doll of claim 1, wherein the single strand of bendable arm wire and the first and second strands of bendable wire comprise a ribbon-like, flattened cross-sectional shape.

9. The doll of claim 1, constructed by:

removing any clothing from a doll lacking internal wiring and including stuffing positioned with an interior of the doll defined by first and second arms, first and second legs, a torso, a head, and a neck;

disconnecting the head from a remainder of the doll at the neck to create a neck opening;

removing any seams present along the torso and the arms and legs of the doll to create a plurality of openings;

removing all or a portion of the stuffing from the interior of the doll via the plurality of openings;

inserting a single strand of bendable arm wire into an opening in the first such that the arm wire passes from the first arm, into the torso, and extends through an opening in the second arm, wherein the single strand of bendable arm wire includes first and second ends positioned exterior to the doll;

inserting a first strand of bendable wire through an opening in the first leg, through the torso, extending through the opening of the neck, wherein the first strand of bendable wire includes first and second ends, both positioned external to the doll;

inserting a second strand of bendable wire through an opening in the second leg, through the torso, extending through the opening of the neck, wherein the second strand of bendable wire includes first and second ends, both positioned external to the doll;

curling the exterior ends of the single strand of bendable arm wire and positioning the curled ends within the interior of the first and second arms;

curling the first end of the first bendable wire and positioning the curled end within the interior of the first leg;

curling the second end of the second bendable wire and positioning the curled end within the interior of the second leg;

curling the second ends of the first and second bendable wires such that the curled second ends contact an interior of the head when the head is attached to the neck;

repositioning the head on the torso at the neck opening using a cable tie to secure the head on the torso, wherein the cable tie is fed through a loop of fabric on the neck;

closing the openings;

thereby creating a self-standing, poseable doll.

10. A self-standing, poseable doll, comprising:

a head;

a torso;

a neck positioned between the head and torso, wherein the neck comprises a hollow that is aligned with an upper opening in the torso and wherein the neck includes a fabric loop positioned around an exterior of the neck, and wherein a cable tie is positioned within the fabric loop to fasten the torso to the neck;

first and second arms attached to the torso, each arm projecting outward from the torso to terminate at a distal end;

a pair of legs defined as a first leg and a second leg attached to the torso, each leg projecting outward from the torso to terminate at a distal end;

a pair of shoes, each shoe fitted on a distal end of a corresponding leg, each shoe comprising a flat lower surface and an interior that cooperates with the distal end of a corresponding leg;

strands of bendable wire defined by curled ends that extend within the head, torso, and legs, wherein each of the pair of legs includes a first single strand of bendable wire comprising a first portion that extends from the distal end of the first leg, through the torso, and into an interior of the head where it bends and extends back as a second portion through the torso, and back through the second leg, terminating at a curled end, wherein the single strand first portion runs alongside the single strand second portion as the portions extend through the first and second legs, through the torso, and into the head;

wherein the strands of bendable wire include a second single strand extending from a distal end of a first arm, through the torso and into a second arm, extending to a distal end of the second arm, wherein the second single strand and first single strand bypass each other in a manner that is free from wrapping around each other and free from connecting to each other;

wherein each strand of bendable wire includes two ends, each configured in a rolled orientation;

wherein the doll is rendered poseable by bending the strands of the bendable wire;

wherein the doll is in a self-standing position on a horizontal surface that remains self-standing because of the shoes fitted on that balance the doll and because of the at least one of the strands of the bendable wire that sturdies the doll.

11. The doll of claim 10, wherein the rolled region is defined as a coiled wire region in a circular shape.

12. The doll of claim 10, wherein the wiring has memory such that it retains a shape until changed by a user.

13. The doll of claim 10, wherein the strands of bendable wire comprise a ribbon-like, flattened cross-sectional shape.

14. The doll of claim 10, wherein the strand of bendable wire positioned within the interior of the head directly contacts the head.

15. The doll of claim 10, wherein the head is part of a hollow thermoplastic formation that also includes the neck, the torso and limbs are cloth-bodied and include stuffing.

16. The doll of claim 10, wherein the distal end regions of the legs are feet.

17. The doll of claim 10, wherein the head is hollow and has an inside facing surface, wherein at least one of the strands of the bendable wire abuts the inside facing surface of the head.

18. The doll of claim 10, constructed by:

removing any clothing from a doll lacking internal wiring and including stuffing positioned with an interior of the doll defined by first and second arms, first and second legs, a torso, a head, and a neck;

disconnecting the head from a remainder of the doll at the neck to create a neck opening;

removing any seams present along the torso and the arms and legs of the doll to create a plurality of openings;

removing all or a portion of the stuffing from the interior of the doll via the plurality of openings;

inserting a single strand of bendable arm wire into an opening in the first such that the arm wire passes from the first arm, into the torso, and extends through an opening in the second arm, wherein the single strand of bendable arm wire includes first and second ends positioned exterior to the doll;

inserting a single strand of bendable leg wire through an opening in the first leg, through the torso, extending upward through the opening of the neck, and then bending and reinserting the single strand in the opposite direction, through the opening in the neck, past the torso and out from an opening in the second leg, wherein the single strand of bendable leg wire includes first and second ends, both positioned external to the doll, one end extending from each leg opening;

curling the exterior ends of the single strand of bendable arm wire and positioning the curled ends within the interior of the first and second arms;

curling the first and second ends of the single strand of bendable leg wire and positioning the curled end within the interior of the first and second legs;

repositioning the head on the torso at the neck opening using a cable tie to secure the head on the torso, wherein the cable tie is fed through a loop of fabric on the neck;

closing the openings;

thereby creating a self-standing, poseable doll.

* * * * *